US005636944A

United States Patent [19]

Buttimore

[11] Patent Number: 5,636,944

[45] Date of Patent: Jun. 10, 1997

[54] ANCHOR FOR A BEACH UMBRELLA

[76] Inventor: Edward P. Buttimore, 20 Vanderberg Pl., Cedar Grove, N.J. 07009

[21] Appl. No.: 548,106

[22] Filed: Oct. 25, 1995

[51] Int. Cl.[6] ..... E02D 5/54

[52] U.S. Cl. ..... 405/244; 52/161; 52/298; 248/530; 405/232; 403/374

[58] Field of Search ..... 405/244, 232, 405/230; 248/533, 530, 545; 52/298, 157–165; 403/374, 343

[56] References Cited

U.S. PATENT DOCUMENTS

| | | | |
|---|---|---|---|
| 2,295,431 | 9/1942 | Shepard et al. | 248/530 |
| 3,066,769 | 12/1962 | Pasquale | 248/530 X |
| 3,342,444 | 9/1967 | Nelson | 248/530 X |
| 3,694,978 | 10/1972 | Mintz | 52/298 X |
| 4,059,934 | 11/1977 | Hayamizu | 52/298 X |
| 4,178,726 | 12/1979 | Watson | 52/161 X |
| 4,269,010 | 5/1981 | Glass | 52/298 X |
| 5,122,014 | 6/1992 | Genfan | 405/244 |
| 5,433,551 | 7/1995 | Gordon | 403/374 X |

*Primary Examiner*—Dennis L. Taylor
*Attorney, Agent, or Firm*—Alfred C. Hill

[57] ABSTRACT

An anchor for a beach umbrella having a canopy and a support post therefore comprising a container having a predetermined hollow, solid geometric configuration capable of being buried in and containing sand, the container including an open top, a bottom and a side wall extending from the open top to the bottom, the bottom having an aperture therein coaxial of a longitudinal axis of the container; a cylindrical member secured in the aperture and extending at least downward from the bottom externally of the container coaxial of an extension of the longitudinal axis to receive an end of the support post; and an arrangement to secure the cylindrical member to the one end of the support post and, hence, to secure the container to the support post. Three embodiments are disclosed, but the compression nut embodiment of FIG. 1 is preferred due to ease of (tool-less) fastening the container to the support post.

10 Claims, 2 Drawing Sheets

ANCHOR FOR A BEACH UMBRELLA

BACKGROUND OF THE INVENTION

The present invention relates to improvements in beach umbrellas and more particularly to a stabilizer-retention device, or anchor, for beach umbrellas which will substantially increase the total static retention forces and lateral stability of a beach umbrella thereby alleviating or preventing lifting forces, caused by steady winds and/or gusts, dislodging a beach umbrella from the sand in which it is supported, or becoming tilted or upset thereby greatly facilitating the use of a beach umbrella in a more stable, secure and safe manner.

Beach umbrellas are frequently employed to provide an area of shade or shelter to protect beachgoers from direct sunrays and provide a somewhat protected area for various paraphernalia used by beachgoers. Conventional beach umbrellas include an elongated, rigid, standard or support post with a pointed lower end which is imbedded into the sand by exerting a downward force on the support post while moving the support post back and forth in an angular manner. However, lifting forces of the wind, wind gusts or subsequent pivotable movement of the umbrella frequently results in the umbrella being upset and/or completely dislodged from the sand. This can result in a hazardous condition since the wind, after dislodging the umbrella, will cause the umbrella to roll or tumble along the beach surface causing an extremely dangerous situation for other beachgoers.

Various arrangements have been developed for more securely anchoring beach umbrellas in place, such as using heavy bases which are difficult and heavy to carry to the beach. Also, a screw or auger type of anchor has been provided which is rather difficult to properly install in view of the torque which must be exerted in order to properly install the auger type anchoring device. The following U.S. patents relate to this type of device: U.S. Pat. Nos. 2,628,797; 2,923,449; 3,289,363; 4,753,411; 5,207,406; 5,271,196 and 5,427,346.

The prior art does include a number of devices to anchor a beach umbrella and thereby prevent a dangerous situation when the umbrella is dislodged and rolled or tumbled by the winds. However, none of the prior art found in a search has disclosed a container having a predetermined hollow, solid geometric configuration, such as, an inverted bell-shaped or cup-like member capable of being buried in and containing sand to hold a beach umbrella in place and provide lateral stability and an increase in static retention forces for a beach umbrella.

SUMMARY OF THE INVENTION

An object of the present invention is to provide an improved anchor or stabilizer-retention device for a beach umbrella.

Another object of the present invention is to provide a stabilizer-retention or anchor device for a beach umbrella which is light weight, easily manufactured and easily installed on an end of a support post for the canopy of a beach umbrella.

A feature of the present invention is the provision of an anchor for a beach umbrella having a canopy and support post therefore comprising a container having a predetermined hollow, solid geometric configuration, such as, an inverted bell-shaped or cup-like member, capable, of being buried in and containing sand, the container including an open top, a bottom and a side wall extending from the open top to the bottom, the bottom having an aperture therein coaxial of a longitudinal axis of the container; a cylindrical member secured in the aperture and extending at least downward from the bottom externally of the container coaxial of an extension of the longitudinal axis to receive an end of the support post; and an arrangement to secure the cylindrical member to the one end of the support post and, hence, to secure the container to the support post.

BRIEF DESCRIPTION OF THE DRAWING

Above-mentioned and other features and objects of the present invention will become more apparent by reference to the following description taken in conjunction with the accompanying drawing, in which.

DESCRIPTION OF THE PREFERRED EMBODIMENTS

Figure 1:
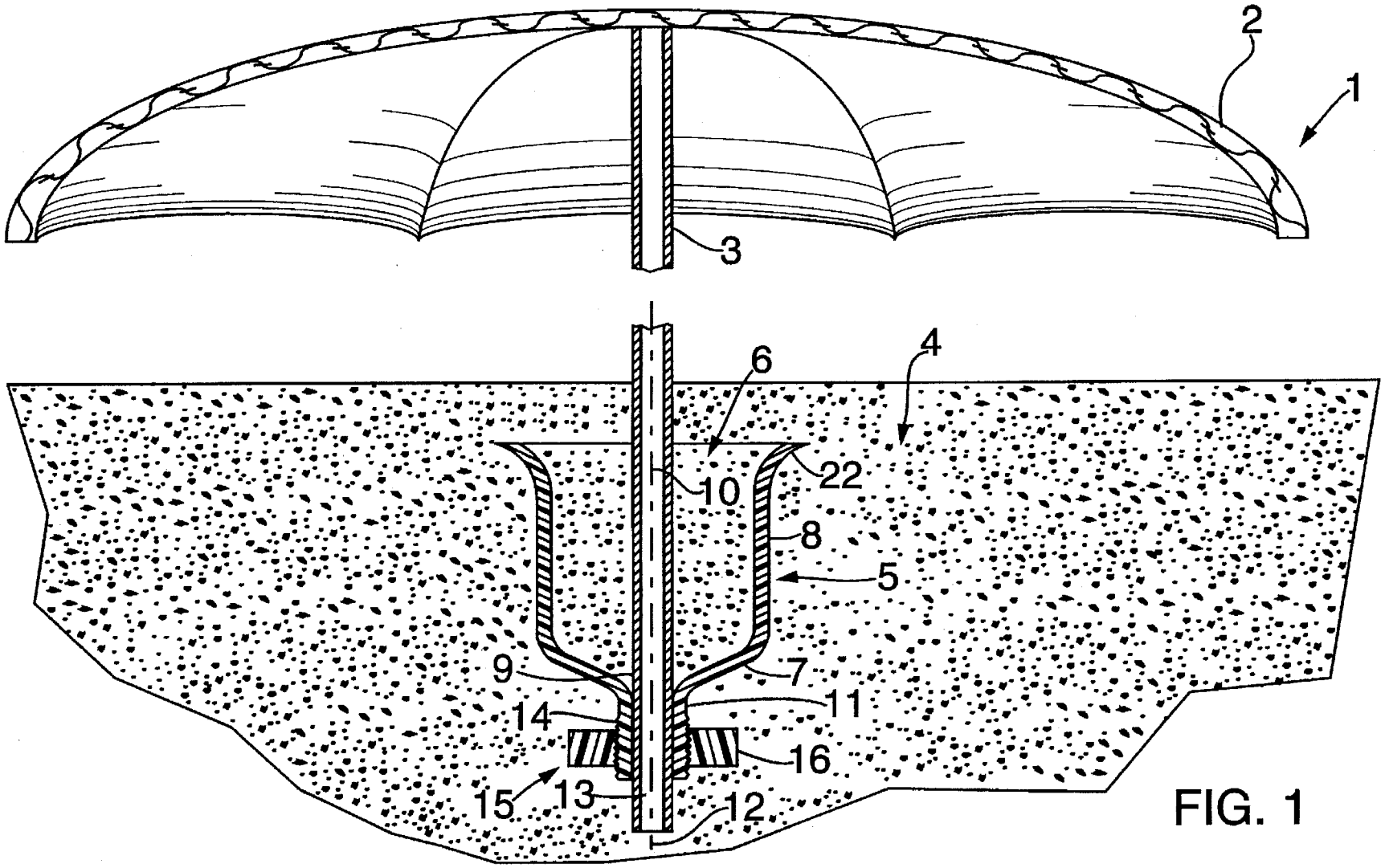
FIG. 1 is a cross-sectional view of a beach umbrella and a first embodiment of an anchor therefore in accordance with the principles of the present invention.

Referring to FIG. 1, there is illustrated therein a beach umbrella 1 having a canopy 2 and a support post 3 anchored in sand 4 by a first embodiment of the anchor in accordance with the principles of the present invention including a container 5 having a predetermined hollow, solid geometric configuration, such as, an inverted bell-shaped or cup-like member.

Container 5 includes an open top 6, a bottom 7 and a side wall 8 extending from the open top 6 to the bottom 7. The bottom 7 includes therein an aperture 9 coaxial of a longitudinal axis 10 of the container 5.

A cylindrical member 11 is secured in aperture 9 or formed as a part of the bottom 7. The cylindrical member 11 extends at least downward from the bottom 7 externally of the container 5 coaxially of an extension 12 of the longitudinal axis 10 to receive an end 13 of the support post 3. The cylindrical member 11 includes threads 14 on an external surface thereof.

An arrangement 15 is provided to secure the cylindrical member 11 to one end 13 of support post 3 to thereby secure the container to the support post 3.

In the embodiment of FIG. 1, this arrangement 15 is illustrated as including a compression nut 16 which is threaded on threads 14 to clamp the cylindrical member 11 to the one end 13 of the support post 3.

Figure 2:
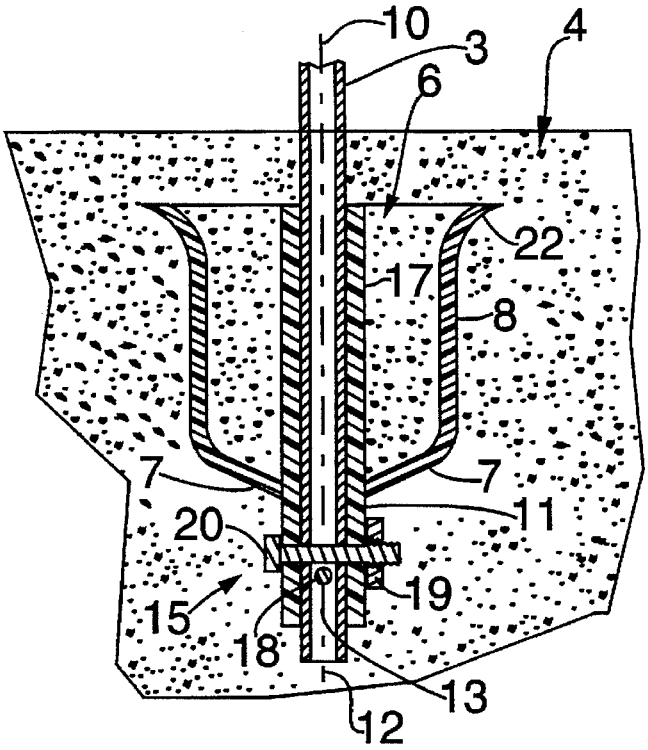
FIG. 2 is a cross-sectional view of second embodiment of the anchor for a beach umbrella in accordance with the principles of the present invention.

Referring to FIG. 2, a second embodiment of a beach umbrella anchor in accordance with the principles of the present invention is illustrated as including the same components as shown in FIG. 1 with the addition of cylindrical member 11 having a portion 17 thereof extending upward from the bottom 7 internally of the container 5 coaxial of the longitudinal axis 10. In accordance with the embodiment of FIG. 2, the arrangement 15 includes at least a first bolt 18 extending through the cylindrical member 11 and one end 13 of support post 3 with a nut 19 being threaded on the bolt 18 to secure the cylindrical member 11 to the end 13 of the support post 3.

As an alternative to the single bolt arrangement, above described, a second bolt 20 can be provided which extends through the cylindrical member 11 and the one end 13 of the support post 3 at a right angle to bolt 18 with a second nut (not illustrated) threaded on second bolt 20 to assist in securing the cylindrical member 11 to the one end 13 of support post 3.

Figure 4:
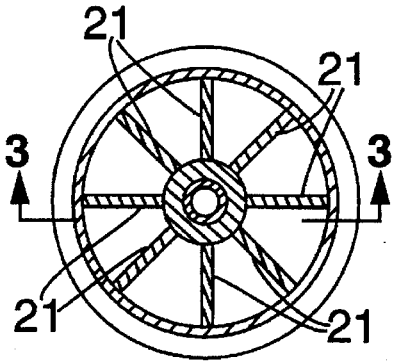
FIG. 4 is a cross-sectional view taken along 4—4 of FIG. 3.
Figure 3:
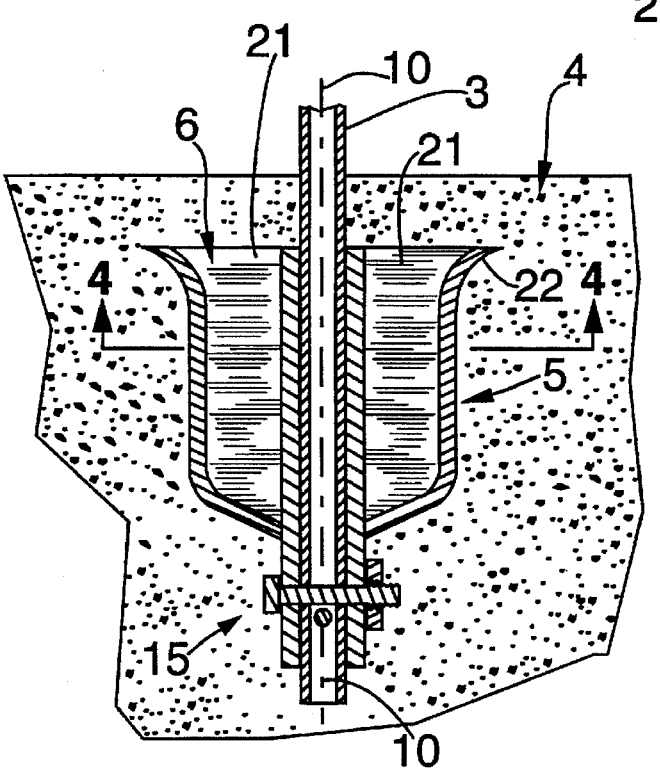
FIG. 3 is a cross-sectional view of a third embodiment of the anchor for a beach umbrella, and illustrating the use of metal rather than plastic for the anchor, in accordance with the principles of the present invention.

Referring to FIGS. 3 and 4, the container 5 is similar to the embodiment of FIGS. 1 and 2, but has added thereto the members 21 extending from portion 17 to the inner surface of the sidewall 8 to thereby strengthen the container 5.

The embodiments of FIGS. 3 and 4, are very similar to that of FIG. 2 as far as arrangement 15 and container 5 is concerned structurally.

As illustrated in FIGS. 1 and 2, the material of the anchor 5 may be made of plastic while the embodiments of FIGS. 3 and 4 illustrate that the anchor, in accordance with the principles of the present invention, can be made of a light weight metal, such as aluminum.

Container 5 is employed as follows, in accordance with the principles of the present invention. Container 5 is buried in sand 4 and contains sand therein to anchor and provide weight for the stabilization and retention of the umbrella 1.

As illustrated in FIGS. 1, 2 and 3, a flange portion 22 is provided adjacent the open top 6 extending away from the longitudinal axis 10. Flange portion 22 increases the anchoring effect of container 5.

As illustrated in FIGS. 1, 2 and 3, container 5 is an inverted bell-shaped or cup-like member. Container 5 may have any desired or predetermined hollow, solid geometric configuration, such as, an open topped inverted cone, an open topped cylinder and any equivalent thereof.

While I have described above the principles of my invention in connection with specific apparatus, it is to be clearly understood that this description is made only by way of example and not as a limitation to the scope of my invention as set forth in the objects thereof and in the accompanying claims.

I claim:

1. An anchor for a beach umbrella having a canopy and a support post therefore comprising:

a container having a predetermined hollow, solid geometric configuration capable of being buried in and containing sand, said container including an open top, a bottom and a sidewall extending from said open top to said bottom, said bottom having an aperture therein coaxial of a longitudnal axis of said container, said sidewall having a flange portion adjacent said open top extending away from said longitudnal axis to increase the anchoring effect of said container;

a cylindrical member secured in said aperture and extending at least downward from said bottom externally of said container coaxial of an extension of said longitudnal axis to receive an end of said support post; and an arrangement to secure said cylindrical member to said one end of said support post and, hence, to secure said container to said support post.

2. An anchor according to claim 1, wherein said cylindrical member includes threads on an external surface thereof; and said arrangement secures includes a compression nut threaded on said threads to clamp said cylindrical member to said one end of said support post.

3. An anchor according to claim 2, wherein said container is an inverted bell-shaped member to provide a further increase in the anchoring effect of said container.

4. An anchor according to claim 3, wherein said inverted bell-shaped member, said cylindrical member and said arrangement to secure are made of a material selected from the group consisting of a plastic and a metal.

5. An anchor according to claim 1, wherein said cylindrical member further includes a portion thereof extending upward from said bottom internally of said container coaxial of said longitudinal axis.

6. An anchor according to claim 5, wherein said cylindrical member and said portion receive said support post; and said arrangement to secure includes at least a first bolt extending through said cylindrical member and said one end of said support post; and a first nut threaded on said first bolt to secure said cylindrical member to said one end of said support post.

7. An anchor according to claim 6, wherein said container is an inverted bell-shaped member to provide a further increase in the anchoring effect of said container.

8. An anchor according to claim 6, wherein said container, said cylindrical member, said portion, said first bolt and said first nut are made of a material selected from the group consisting of a plastic and a metal.

9. An anchor according to claim 6, wherein said arrangement to secure further includes a second bolt extending through said cylindrical member and said one end of said support post at a right angle to and spaced from said first bolt; and a second nut threaded on said second bolt to assist in securing said cylindrical member to said one end of said support post.

10. An anchor according to claim 5, further including a plurality of members spaced from each other disposed vertically with respect to said bottom extending from an interior surface of said sidewall to said portion to strengthen said container.

* * * * *